US012330016B2

(12) United States Patent
Spielman

(10) Patent No.: US 12,330,016 B2
(45) Date of Patent: Jun. 17, 2025

(54) RESISTANCE-INCREASING EQUIPMENT

(71) Applicant: Eric Spielman, Nederland, CO (US)

(72) Inventor: Eric Spielman, Nederland, CO (US)

( * ) Notice: Subject to any disclaimer, the term of this patent is extended or adjusted under 35 U.S.C. 154(b) by 115 days.

(21) Appl. No.: 17/750,669

(22) Filed: May 23, 2022

(65) Prior Publication Data

US 2023/0372771 A1 Nov. 23, 2023

(51) Int. Cl.
*A63B 21/00* (2006.01)

(52) U.S. Cl.
CPC ..... *A63B 21/4047* (2015.10); *A63B 21/0004* (2013.01); *A63B 21/4034* (2015.10); *A63B 2225/09* (2013.01)

(58) Field of Classification Search
CPC ..... A63B 21/0004; A63B 21/4034; A63B 21/4047; A63B 2225/09
See application file for complete search history.

(56) References Cited

U.S. PATENT DOCUMENTS 5,106,079 A 4/1992 Escobedo et al.
5,971,902 A * 10/1999 Robertson ..... A61H 1/0292 601/24
6,592,497 B2 * 7/2003 Greenheck ..... A63B 23/0494 482/79
7,367,928 B2 5/2008 Storch
8,690,742 B1 * 4/2014 Herman ..... A63B 21/0552 482/904
9,498,399 B1 * 11/2016 Juntunen ..... A63B 69/0062
10,363,449 B2 7/2019 Scott et al.
10,610,730 B2 4/2020 Andersen
2002/0119872 A1 * 8/2002 Greenheck ..... A63B 21/4015 482/106
2008/0058173 A1 * 3/2008 Mattox ..... A63B 23/0205 482/92

FOREIGN PATENT DOCUMENTS

NL 1025935 C2 * 10/2005 ..... A63B 21/072

* cited by examiner

*Primary Examiner* — Zachary T Moore

(57) ABSTRACT

Exercise equipment includes a primary support member, a pivot provided to an end of the lever beam, a stabilizer provided to the primary support member distal from the fulcrum and at least one step provided to the primary support member intermediate the pivot and the stabilizer. The exercise equipment extends effective length of a user during a bodyweight exercise by increasing a lever length and distancing a user's feet from a fulcrum. With the lever lengthened or extended by way of the exercise equipment, resistance is increased.

23 Claims, 5 Drawing Sheets

RESISTANCE-INCREASING EQUIPMENT

TECHNICAL FIELD

The disclosure pertains to sustaining or improving health and fitness through the use of equipment.

SUMMARY

The disclosure describes exercise equipment. The equipment includes a primary support member having a longitudinal axis, a pivot provided to an end of the primary support member, a stabilizer provided to the primary support member distal from the pivot and at least one step provided to the primary support member intermediate the pivot and the stabilizer.

The disclosure also describes exercise equipment for extending effective length of a user. The equipment includes a primary support member having a longitudinal axis, a pivot provided to an end of the primary support member, a stabilizer provided to the primary support member distal from the pivot and at least one step provided to the primary support member intermediate the pivot and the stabilizer. The pivot further includes a non-slip surface and is configured to restrict the primary support member to rotation about a single axis.

BRIEF DESCRIPTION OF THE FIGURES

The summary above, as well as the following detailed description of illustrative embodiments, is better understood when read in conjunction with the appended drawings. For the purpose of illustrating the disclosure, example constructions are shown in the drawings. However, the disclosure is not limited to specific methods and instrumentalities disclosed herein. Moreover, those having ordinary skill in the art will understand that the drawings are not to scale. Wherever possible, like elements have been indicated by identical numbers.

Embodiments of the disclosure will now be described, by way of example only, with reference to the following diagrams wherein.

DETAILED DESCRIPTION

Figure 1:
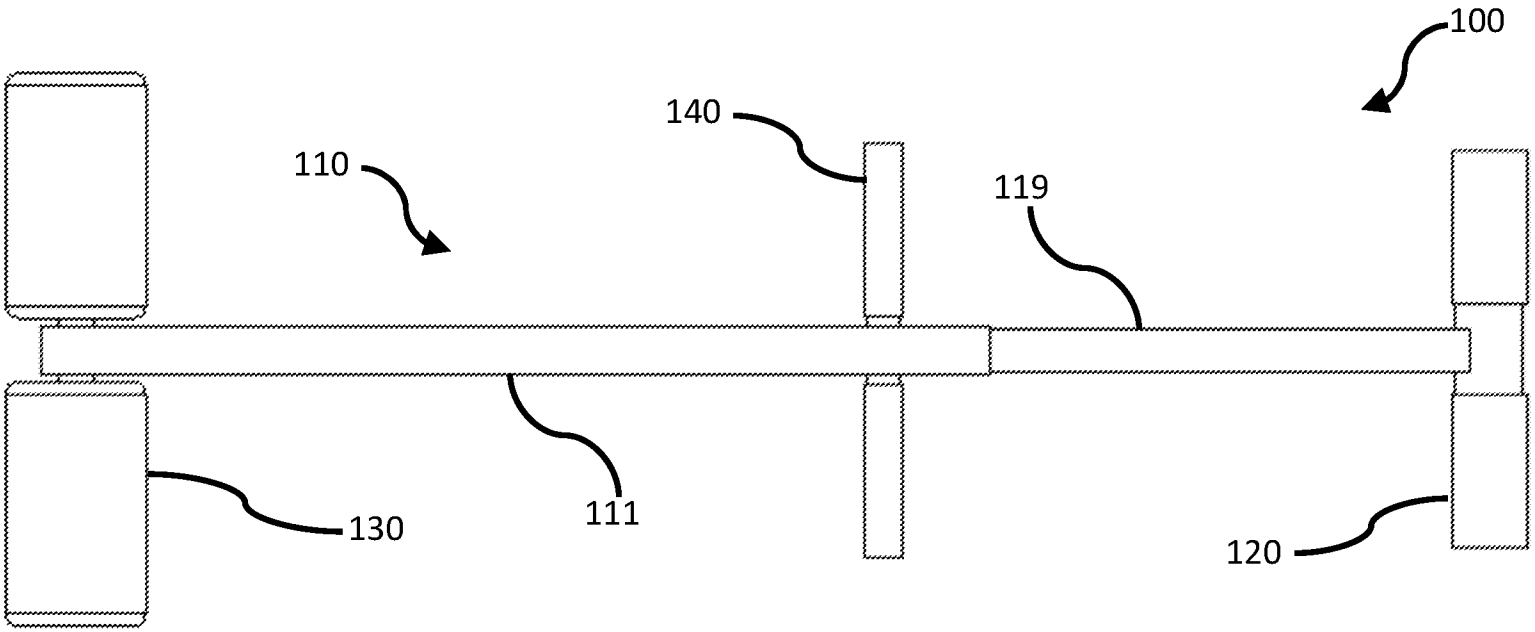
FIG. 1 illustrates a top view of exercise equipment in accordance with the disclosure.

The following detailed description illustrates embodiments of the disclosure and manners by which they can be implemented. Although the best mode of carrying out disclosed devices, equipment and methods has been described, those of ordinary skill in the art would recognize that other embodiments for carrying out or practicing disclosed devices, equipment and methods are also possible.

It should be noted that the terms "first", "second", and the like, herein do not denote any order, quantity, or importance, but rather are used to distinguish one element from another. Further, the terms "a" and "an" herein do not denote a limitation of quantity, but rather denote the presence of at least one of the referenced item.

Known exercise techniques use greater weight and/or large, expensive equipment to achieve greater strength and muscle growth when bodyweight exercises do not provide adequate resistance.

Embodiments of the disclosure provide resistance-increasing exercise equipment. Further, methods suitable for use in association with the resistance-increasing exercise equipment are also described.

Embodiments of the disclosure substantially eliminate, or at least partially address, problems in the prior art, enabling users to achieve greater strength and muscle growth with bodyweight exercises without the need to add external weights or elastic resistance.

Additional aspects, advantages, features and objects of the disclosure will be made apparent from the drawings and the detailed description of the illustrative embodiments construed in conjunction with the appended claims that follow. It will be appreciated that described features are susceptible to being combined in various combinations without departing from the scope of the disclosure as defined by the appended claims.

FIGS. 1-5 illustrate exercise equipment 100 in accordance with the disclosure. Exercise equipment or device 100 may extend effective length of a user during a bodyweight exercise, for example, by lengthening a lever and distancing a user's feet from a fulcrum. With the lever lengthened or extended by way of the exercise equipment, resistance is increased. Exercise equipment 100 may extend effective length of a user and thereby increase resistance during planks, push-ups or bodyweight rows from a static horizontal bar.

Exercise equipment 100 includes a primary support member, lever beam or lever 110 with first and second ends and a length defined therebetween. A longitudinal axis is defined along its length. A pivot, fulcrum or foot 120 is provided to primary support member 110. A stabilizer, brace or handle 130 is provided to primary support member 110 distal from pivot 120. A step or footrest 140 is provided intermediate pivot 120 and stabilizer 130.

Primary support member 110 may take any of a variety of elongate forms having a variety of cross-sectional shapes including but not limited to triangular, ovular, circular, rectangular or square. In an example, primary support member 110 takes the form of a tube to reduce weight. Primary support member 110 may be formed from any of a variety of durable, hard and rigid materials suitable for withstanding a user's bodyweight as well as shear stress and bending moments caused thereby. Suitable materials include but are not limited to plastic, wood or metal.

Pivot 120 is provided to a first end of primary support member 110 and is configured to pivotably support the end of primary support member 110 on a support surface. Pivot 120 may further include a non-slip surface. In an example, the non-slip surface is rubber.

Pivot 120 may be further configured to prevent rotation of primary support member 110 about the longitudinal axis. For example, pivot 120 may extend from primary support member 110 in first and second directions which may be opposite. In a further example, pivot 120 may extend from primary support member 110 substantially transverse thereto. By extending substantially transverse to support member 110, pivot 120 would appear to be transverse in the eye of an ordinary, unaided observer. In this arrangement, pivot 120 may take the form of a cross bar or cross-beam and may function as a fulcrum peg or fulcrum bar having a pivot axis in the direction of its length.

Pivot 120 may be configured in a shape that does not extend transverse to primary support member 110 or that does not extend far from primary support member 110 such that a user must provide additional stability to prevent the primary support member 110 from rotating about its longitudinal axis. Alternatively or additionally, pivot 120 may include a wheel to increase exercise difficulty by requiring the user stabilize against movement of pivot 120 relative to a support surface.

Step 140 is provided between the first and second ends of primary support member 110 and is configured to support one or both of a user's feet. In an example, step 140 extends from primary support member 110 in first and second directions which may be opposite. In a further example, step 140 extends from primary support member 110 substantially transverse thereto. By extending substantially transverse to support member 110, step 140 would appear to be transverse in the eye of an ordinary, unaided observer. In this arrangement, step 140 may take the form of a cross bar or cross-beam and may function as a traction peg or foot anchor.

Step 140 is configured to input a force through primary support member 110 to pivot 120. Force applied to step 140 may be configured to act through primary support member 110 to anchor pivot 120 to a support surface, for example, through static friction. Step 140 may further include a non-slip surface which increases friction coefficients. In an example, the non-slip surface is rubber.

Step 140 may be provided on one side or the other of primary support member 110 (FIG. 2) rather than going through primary support member 110. In this arrangement, the angle of the user's legs relative to primary support member 110 may be changed by flipping the equipment over around the support member longitudinal axis.

Stabilizer 130, provided to primary support member 110 a first distance from step 140 and a second, greater distance from pivot 120, is configured to input, to primary support member 110, a force suitable to rotate the same on pivot 120. In an example, stabilizer 130 is provided to the second end of primary support member 110.

Stabilizer 130 may be positioned below a user's knee joint or higher up the legs to mechanically benefit user comfort while counteracting the shear stress upon the legs that is caused during use, and is further configured to maintain an angle between primary support member 110 and a lever 310 anchored at step 140 and extending to stabilizer 130. For example, pivoting of a user's leg relative to step 140 may be prevented by stabilizer 130 when the user's feet are pressed against engaged with step 140. A user's legs may engage equipment 100 in a cantilevered lever arrangement.

In an example, stabilizer 130 extends from primary support member 110 in first and second directions which may be opposite directions. In a further example, stabilizer 130 extends from primary support member 110 substantially transverse thereto. By extending substantially transverse to support member 110, stabilizer 130 would appear to be transverse in the eye of an ordinary, unaided observer. In this arrangement, stabilizer 130 may take the form of a cross bar or cross-beam upon which additional weights could readily be added for additional exercise resistance. While stabilizer 130 may not necessarily be grasped with a user's hand, it may nevertheless also be considered a handle or handle peg for its engagement with a part of the user during operation, such as one or both of the user's legs.

A force- or stress-absorbing material may be provided around stabilizer 130. For example, stabilizer 130 may include a pad to absorb pressure between the stabilizer and a user's body.

Figure 2:
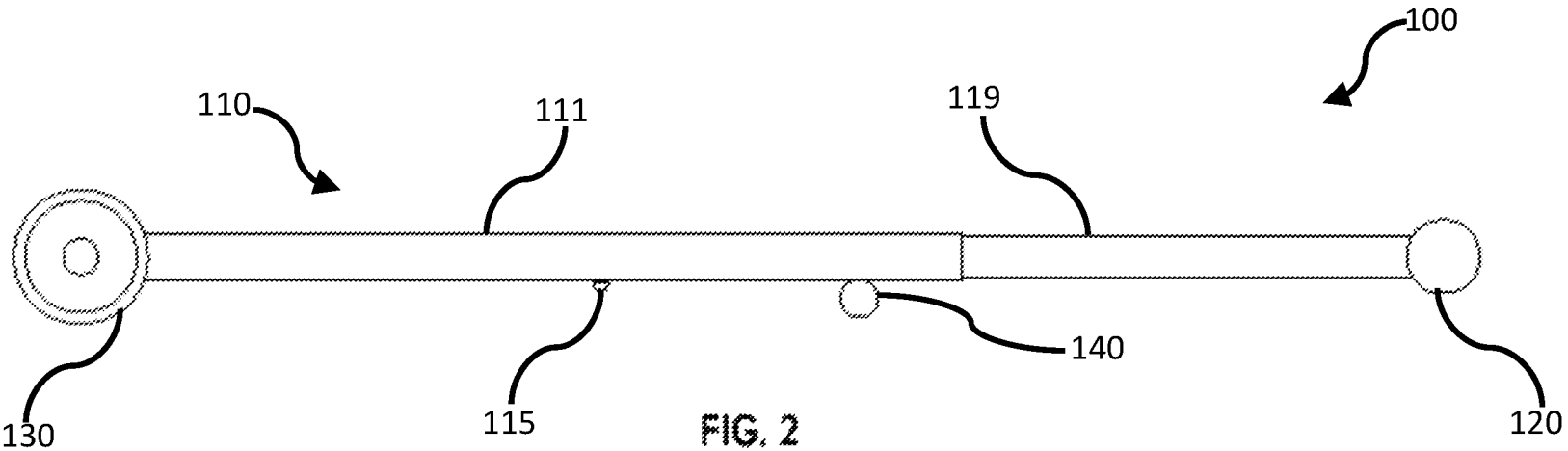
FIG. 2 illustrates a side view of the exercise equipment of FIG. 1.
Figure 3:
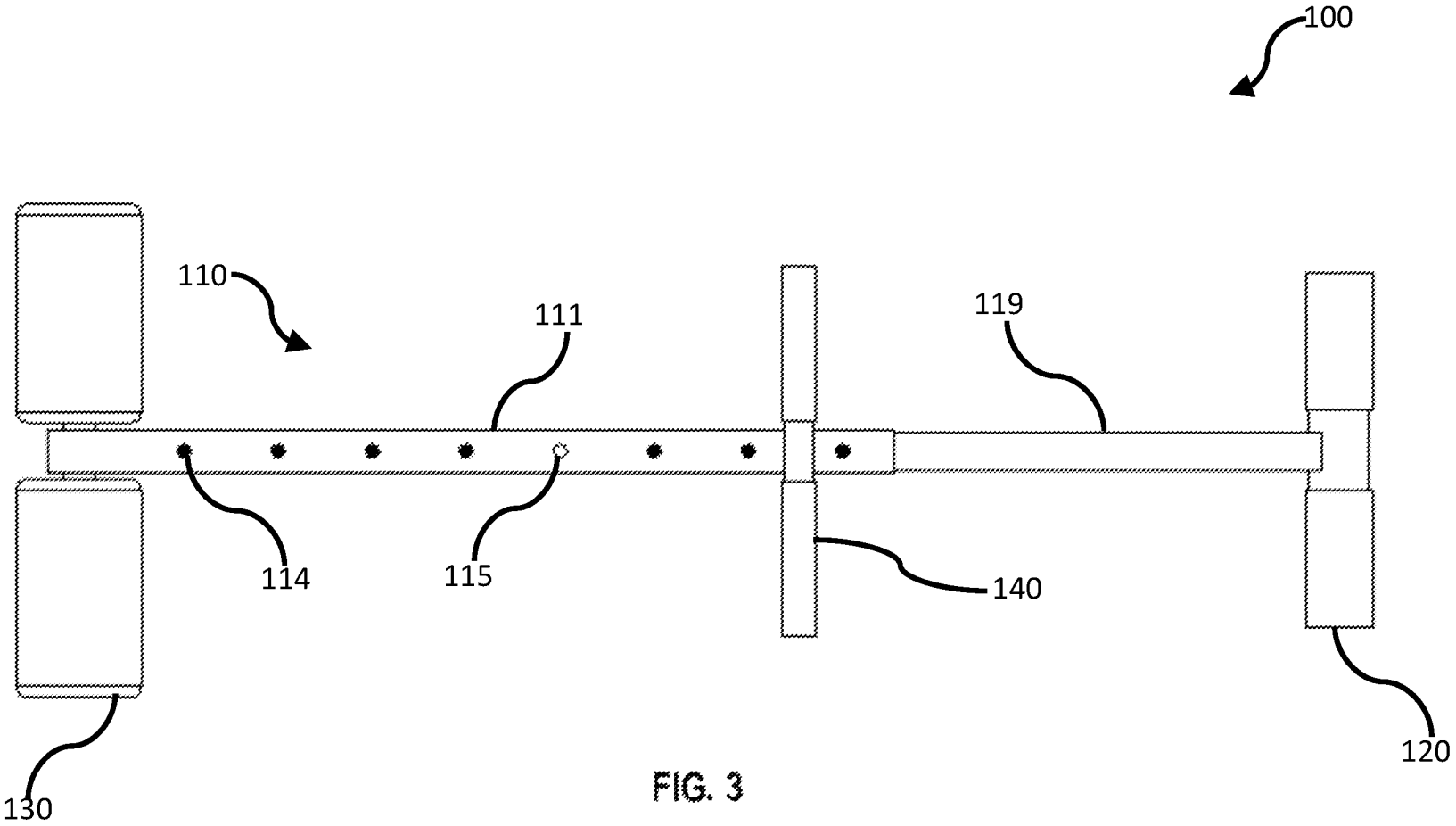
FIG. 3 illustrates a bottom view of the exercise equipment of FIGS. 1 & 2.
Figure 4:
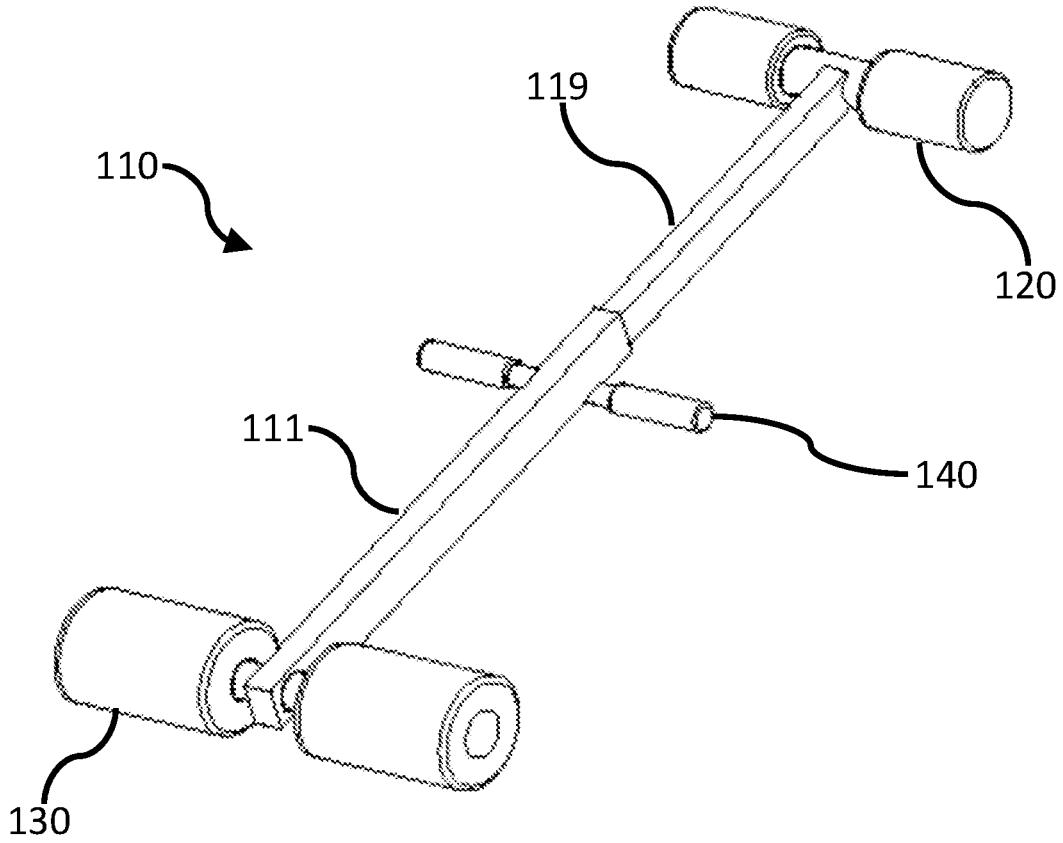
FIG. 4 shows a first perspective view of the exercise equipment of FIGS. 1-3.
Figure 5:
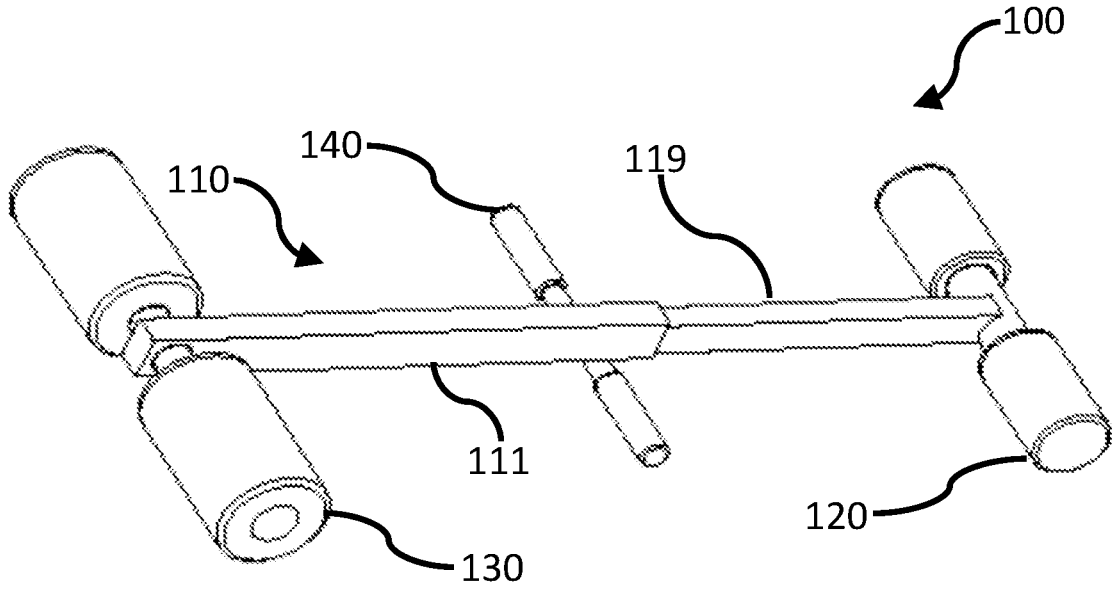
FIG. 5 illustrates a second perspective view of the exercise equipment of FIGS. 1-4.

Pivot 120, step 140 and stabilizer 130 may be relatively aligned when viewed down the longitudinal axis of primary support member 110 (FIG. 2). In this arrangement, angles having a vertex coincident with the longitudinal axis and measured between the extensions of the pivot, the stabilizer and the step are approximately 0 degrees. Angles of approximately 0 degrees would not be distinguishable from 0 degrees to an ordinary, unaided observer and are sufficiently close to zero to enable balanced use of equipment 100.

Alternatively, pivot 120, step 140 and stabilizer 130 may be relatively twisted about the longitudinal axis such that these angles are non-zero.

Primary support member 110 may be configured to selectively vary a distance between pivot 120 and step 140 and/or selectively vary a distance between pivot 120 and stabilizer 130. For example, primary support member 110 may include first and second telescoping segments 111 and 119. In the case where primary support member 110 takes a tubular form, the primary support member may include first and second telescoping support tubes.

A lock 115 may selectively secure first 111 and second 119 telescoping segments at any of a variety of lengths. Lock 115 may further include a series of holes 114 in each of the first and second telescoping segments 111 and 119 and a spring and detent. For example, a pin may be configured for insertion through aligned holes of the first and second telescoping segments and biased into the inserted position by a spring. Alternatively, a pin may be inserted through aligned holes of the first 111 and second 119 telescoping segments.

While equipment 100 may be provided in any of a variety of dimensions suitable for increasing a length of a user-plus-equipment system, in an example, stabilizer 130 is distanced 41 inches from pivot 120 in a static version with about 23 inches between the stabilizer and the step and about 18 inches between the pivot and the footrest. In variable length forms, equipment 100 may distance stabilizer 130 41 inches from pivot 120 in the median setting with about 18 inches between the pivot and the step also in the median setting. By being lightweight, being selectively monolithic and having a small footprint, the equipment may be readily, manually transported by a single user.

According to a first example method for increasing resistance of an exercise, a distance between a user's force and a pivot is increased and a distance between a load and the pivot is also increased.

According to a second example method for performing an increased resistance exercise, feet of a body are supported above a surface and an angle between the body and the distance between the feet and the surface are changed.

According to a third example method for performing an increased resistance exercise, a first hand of a body is placed on a support surface, a second hand of the body is placed on the support surface and, with an elongate member having first and second ends, feet of the body are supported intermediate the first and second ends. Elbows of the body are bent/flexed to pivot the body about an axis at the support surface to decrease an angle between the body and the support surface and then the elbows are straightened/extended to increase the angle defined between the support surface and the body. Ankles, knees, hips and shoulders of the body may be generally aligned with the elongate member. The elbows are bent and straightened for the desired or required number of repetitions.

Disclosed exercise equipment may be suitable for use in association with a variety of exercise methods.

Figure 6:
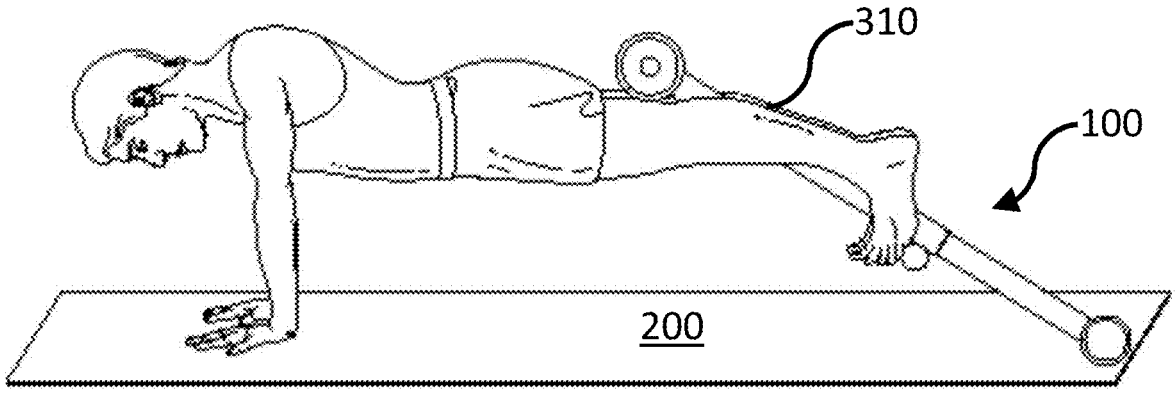
FIG. 6 illustrates a side view of a first position of an example exercise suitable for performance with disclosed exercise equipment.
Figure 7:
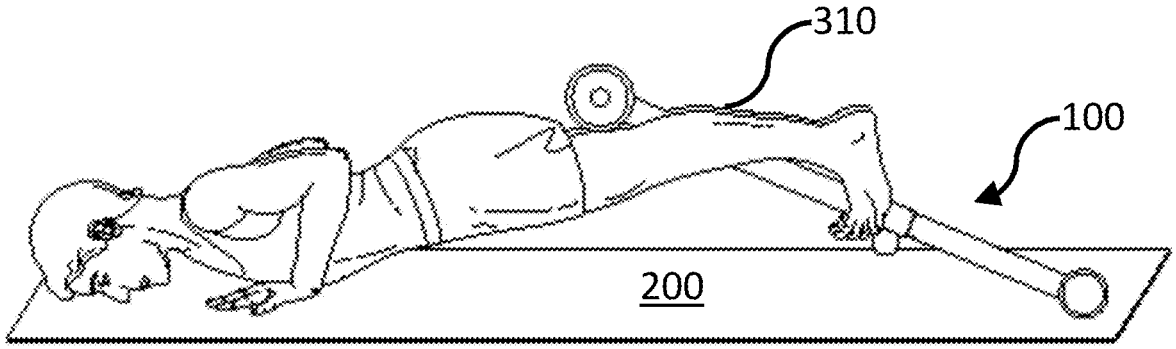
FIG. 7 illustrates a side view of a second position of an example exercise suitable for performance with disclosed exercise equipment.

With reference to FIGS. 6 & 7, in a first example, with equipment 100 having a primary support member supporting a step or footrest between a pivot and a stabilizer, the pivot is placed on a support surface 200 and the stabilizer is held at a greater elevation than the pivot. A first foot is placed on the step or footrest with the stabilizer engaging a position on a first leg and the user places a first hand on support surface 200. A second foot is placed on the step or footrest with the stabilizer engaging a position on a second leg and the user places a second hand on support surface 200.

The elbows are then bent to decrease an angle defined between support surface 200 and the primary support member and subsequently straightened to increase the angle defined between support surface 200 and the primary support member. Bending and straightening of the elbows may be repeated for the desired or required number of times. FIG. 6 illustrates a first position of this example exercise wherein user elbows are extended or straight while FIG. 7 illustrates a second position of the example exercise wherein user elbows are flexed or bent. This method reflects an increased resistance push-up exercise.

In a second example, with equipment having a primary support member supporting a step or footrest between a pivot and a stabilizer, the pivot is placed on a support surface and the stabilizer is held at a greater elevation than the pivot. A first foot is placed on the step or footrest with the stabilizer engaging a position on a first leg and the user grasps a static, horizontal bar with a first hand. A second foot is placed on the step or footrest with the stabilizer engaging a position on a second leg and the user grasp's the static, horizontal bar with a second hand.

The elbows are then bent to increase an angle defined between the support surface and the primary support member and subsequently straightened to decrease the angle defined between the support surface and the primary support member. Again, the bending and straightening may be repeated for the desired or required number of times. This method reflects an increased resistance rowing exercise.

In a third example, with equipment provided having a primary support member supporting a step or footrest between a pivot and a stabilizer, the pivot is placed on a support surface and the stabilizer is held at a greater elevation than the pivot. A first foot is placed on the step or footrest with the stabilizer engaging a position on a first leg and the user places a first hand on the support surface. A second foot is placed on the step or footrest with the stabilizer engaging a position on a second leg and the user places a second hand on the support surface.

The elbows are then maintained in a straight configuration to maintain the angle defined between support surface 200 and the primary support member (FIG. 6). The position may be held for the desired or required duration. This method reflects an increased resistance plank exercise. In an alternative, the angle defined between the support surface and the primary support member may be maintained with the elbows bent such that they and the forearms rest on the support surface.

The actions described above are only illustrative and other alternatives can also be provided where one or more actions are added, one or more actions are removed, or one or more actions are provided in a different sequence without departing from the scope of the claims herein.

Figure 8:
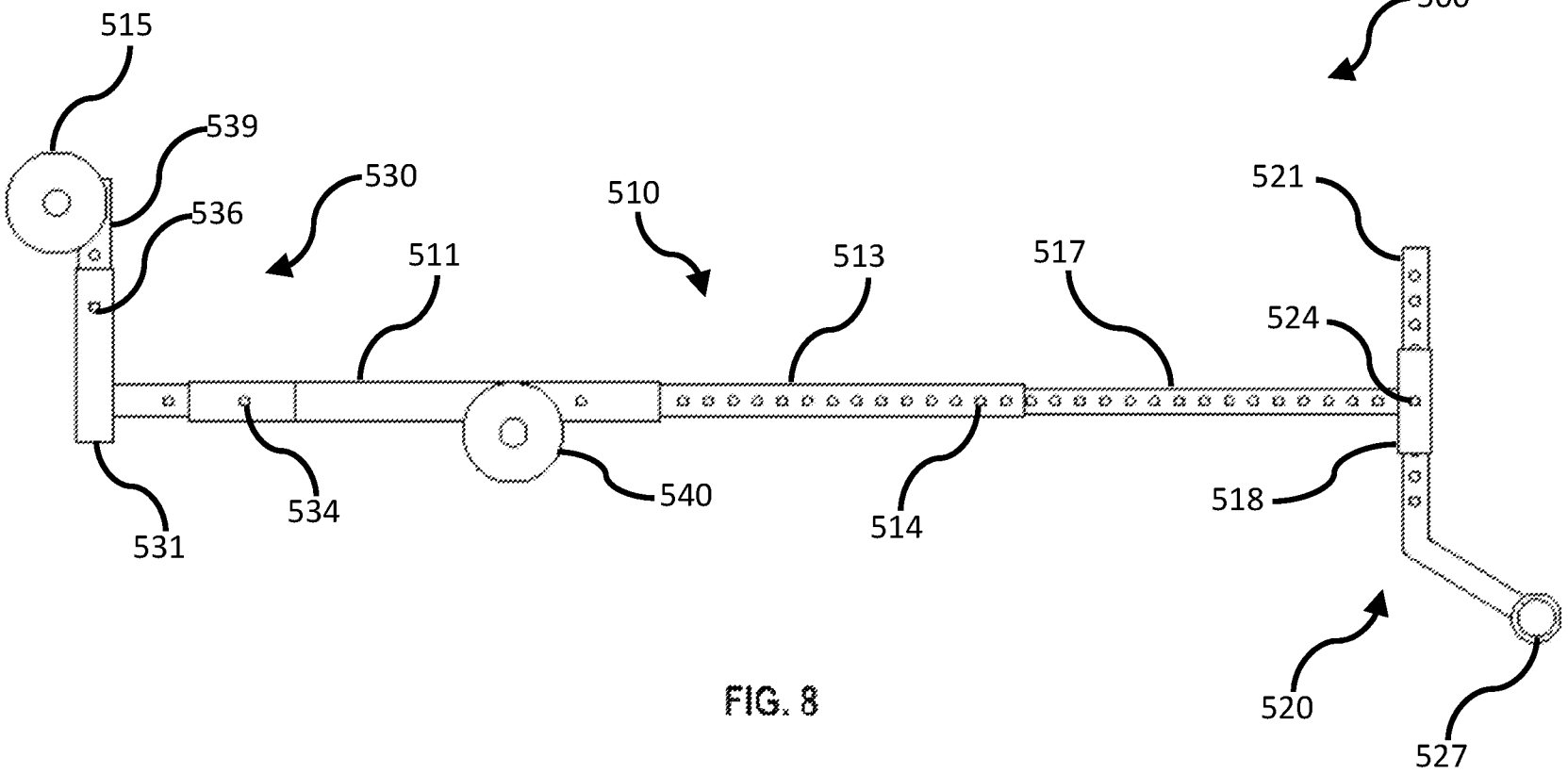
FIG. 8 illustrates other example exercise equipment.

FIG. 8 illustrates another example of exercise equipment. Exercise equipment 500 includes a primary support member 510 with first 511, second 513 and third 517 telescoping segments. In the case where primary support member 510 takes a tubular form, the primary support member may include first, second and third telescoping support tubes. As with primary support member 110, primary support member 510 may take any of a variety of elongate forms having a variety of cross-sectional shapes including but not limited to triangular, ovular, circular, rectangular or square.

A lock may selectively secure first, second and third telescoping segments 511, 513 and 517 at any of a variety of lengths. The lock may further include a series of holes 514 in each of the first, second and third telescoping segments and a spring and detent. For example, a pin may be configured for insertion through aligned holes 514 of the first, second and third telescoping segments and biased into the inserted position by a spring. Depression of the pin against the spring below the surface of the segments enables relative sliding. Alternatively, a pin may be inserted through aligned holes 514 of the first, second and third telescoping segments.

In addition to enabling selectively varying the length of primary support member 510 with first, second and third segments 511, 513 and 517, equipment 500 enables selective varying of a distance between a pivot 527 and primary support member 510 in a direction substantially transverse to primary support member 510, as well as selective varying of a distance between stabilizer 515 and the primary support member 510 in a direction substantially transverse to primary support member 510.

For example, holes 524 may be aligned and a pin or detent passed therethrough while holes 536 may be aligned and a pin or detent passed therethrough. A lock may selectively secure member 520 within sleeve 518 of primary support member 510 at a variety of positions to space pivot 527 a desired transverse distance from primary support member 510. A lock may also selectively secure member 530 within primary support member 510 at a variety of positions to space stabilizer 515 a desired distance from primary support member 510. Similarly, a lock may selectively secure member 539 within sleeve 531 at a variety of positions to space stabilizer 515 a desired transverse distance from primary support member 510. Alternatively, the pivot may be pivotably fixed to the primary support member.

As suggested above, the locks may include a series of holes 514 in each of telescoping segments and a spring and detent. For example, a pin may be configured for insertion through aligned holes 524, 534 or 536 third telescoping segments and biased into the inserted position by a spring. Again, depression of the pin against the spring below the surface of the segments enables relative sliding. Alternatively, a pin may be inserted through aligned holes 524, 534 or 536 and corresponding aligned holes 514 of the telescoping segments to lock the corresponding segments at a selected position.

Structural members 520 and 539 may take any of a variety of elongate forms having a variety of cross-sectional shapes including but not limited to triangular, ovular, circular, rectangular or square. Sleeves 518 and 539 may take any of a variety of shapes complimentary to members 520 and 530, respectively.

Embodiments of the disclosure are susceptible to being used for various purposes, including, though not limited to, enabling users to perform variations of exercises which increase resistance.

Modifications to embodiments of the disclosure described in the foregoing are possible without departing from the scope of the disclosure as defined by the accompanying claims. Expressions such as "including", "comprising", "incorporating", "consisting of", "have", "is" used to describe and claim disclosed features are intended to be construed in a non-exclusive manner, namely allowing for items, components or elements not explicitly described also to be present. Reference to the singular is also to be construed to relate to the plural.

What is claimed is:

1. Exercise equipment, comprising:

a primary support member having a longitudinal axis;

a ground-bearing pivot coupled to an end of the primary support member;

a stabilizer coupled to the primary support member distal from the pivot;

at least one step coupled to the primary support member such that a gravitational vector intersecting a midpoint of the at least one step is intermediate the ground-bearing pivot and the stabilizer, and force applied to the at least one step anchors the pivot to a support surface;

the at least one step and the stabilizer are configured to engage a user's legs in a lever arrangement extending between the at least one step and the stabilizer; and the at least one step is configured to engage a user's feet with one foot on either side of the primary support member.

2. The equipment as set forth in claim 1, wherein the pivot is provided with at least one non-slip surface.

3. The equipment as set forth in claim 1, wherein the step is provided with at least one non-slip surface.

4. The equipment as set forth in claim 1, wherein each of the pivot, the stabilizer and the step extend from the primary support member in first and second directions.

5. The equipment as set forth in claim 4, wherein the first and second directions are opposite directions.

6. The equipment as set forth in claim 4, wherein each of the pivot, the stabilizer, and the step extend from the primary support member in an approximately transverse orientation.

7. The equipment as set forth in claim 1, wherein the equipment is configured to be flipped 180 degrees about an axis of the primary support member.

8. The equipment as set forth in claim 1, wherein the equipment is configured to selectively vary a distance between the pivot and step.

9. The equipment as set forth in claim 1, wherein the equipment is configured to selectively vary a distance between the pivot and stabilizer.

10. The equipment as set forth in claim 1, wherein the primary support member includes first and second telescoping segments.

11. The equipment as set forth in claim 10, further comprising a lock configured to selectively secure first and second telescoping segments at a variety of lengths.

12. The equipment as set forth in claim 11, wherein the lock further comprises a series of holes.

13. The equipment as set forth in claim 1, wherein the stabilizer is configured to resist pivoting, about an axis of the step, of an object extending between the step, and the stabilizer.

14. The equipment as set forth in claim 1, further comprising a force-absorbing material provided around the stabilizer.

15. The equipment as set forth in claim 1, wherein the stabilizer is configured to selectively vary an angle as measured between the stabilizer and the pivot with a vertex coincident to a midpoint of the step.

16. The equipment as set forth in claim 1, wherein at least one wheel is provided to the pivot.

17. The equipment as set forth in claim 1, wherein the equipment is configured for manual transport by the user.

18. The equipment as set forth in claim 1, wherein the pivot is configured to selectively vary an angle as measured between the stabilizer and the pivot with a vertex coincident to a midpoint of the step.

19. The equipment as set forth in claim 18, wherein the pivot is provided at an angle relative to the longitudinal axis of the primary support member.

20. Exercise equipment for extending effective length of a user, comprising:

a primary support member having a longitudinal axis;

a ground-bearing pivot coupled to an end of the primary support member;

a stabilizer coupled provided to the primary support member distal from the pivot; and at least one step coupled to the primary support member such that a gravitational vector intersecting a midpoint of the at least one step is intermediate the ground-bearing pivot and the stabilizer-, and force applied to the at least one step anchors the pivot to a support surface; and the at least one step is configured to engage a user's feet with one foot on either side of the primary support member.

21. The equipment as set forth in claim 20, wherein the equipment is configured for manual transport by the user.

22. Exercise equipment for extending effective length of a user, comprising:

a primary support member having a longitudinal axis;

coupled to an end of the primary support member, a ground-bearing pivot having a non-slip surface;

a stabilizer coupled to the primary support member distal from the pivot and provided with a force-absorbing material;

at least one step coupled to the primary support member intermediate and aligned with the pivot and the stabilizer; and the at least one step configured to engage a user's feet with one foot on either side of the primary support member.

23. The exercise equipment of claim 22, wherein the step further comprises a non-slip surface.

* * * * *